US006937918B2

(12) United States Patent
Bahlmann et al.

(10) Patent No.: US 6,937,918 B2
(45) Date of Patent: Aug. 30, 2005

(54) TEXTILE MACHINE WITH MULTIPLE WORK STATIONS AND A MACHINE BUS FOR COMMUNICATION

(75) Inventors: Bernd Bahlmann, Schrobenhausen (DE); Mario Maleck, Kipfenberg (DE); Erwald Lenk, Ingolstadt (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 0 days.

(21) Appl. No.: 10/392,060

(22) Filed: Mar. 19, 2003

(65) Prior Publication Data

US 2004/0024484 A1 Feb. 5, 2004

(30) Foreign Application Priority Data

Mar. 21, 2002 (DE) ..... 102 12 712

(51) Int. Cl.[7] ..... G06F 19/00
(52) U.S. Cl. ..... 700/130
(58) Field of Search ..... 700/130, 126, 700/139, 143; 57/1 R, 264, 265, 263

(56) References Cited

U.S. PATENT DOCUMENTS

| | | | | |
|---|---|---|---|---|
| 4,408,447 A | * | 10/1983 | Sloupensky et al. | 57/263 |
| 4,491,831 A | | 1/1985 | Sakai et al. | |
| 4,774,673 A | | 9/1988 | Aemmer | |
| 4,944,033 A | * | 7/1990 | Erni | 700/130 |
| 5,394,334 A | * | 2/1995 | Simon | 700/139 |
| 6,381,511 B1 | | 4/2002 | Hermanns et al. | |

FOREIGN PATENT DOCUMENTS

| | | |
|---|---|---|
| DE | 3911850 A1 | 10/1990 |
| EP | 0832997 A2 | 4/1998 |
| EP | 0832997 B1 | 4/1998 |

OTHER PUBLICATIONS

German Patent Office Search Report, Aug. 26, 2002.

Standard–Datennetzwerk Fur Die Textilindustrie, Simon, Karsten, pp. 299–302; Mar., 1992.

* cited by examiner

*Primary Examiner*—John J. Calvert
*Assistant Examiner*—Brian Kauffman
(74) *Attorney, Agent, or Firm*—Dority & Manning, P.A.

(57) ABSTRACT

The invention concerns a textile machine (10) with a multiplicity of workstations (41*a–d*), one electronic device (42) per workstation, a central machine control (20, 22), a machine bus (25) for communication between the machine control and each or possibly a group (30*a–d*) of electronic device(s) and a sensor apparatus (43) for each workstation. A central evaluation unit (24) is provided for the assessment of sensor data from the sensor apparatuses (44), whereby the sensor data embraces continually measured characteristic values and/or the quality or signal data derived therefrom. The central evaluation unit (24) is connected by means of a first communication connection (23, 23') with the machine control (20, 22) or so connected by the machine bus (25). The sensor apparatuses (43) are connected with the evaluation unit (24) through a second communication connection (23, 25, 31*a*, 40, 44, 45) and the second communication connection embraces at least the machine bus (25) and the first communication connection (23, 23'). A procedure for the transmission of sensor data in the case of a textile machine provides the transmission of the data from sensor apparatuses (43) to a central evaluation unit (24) at least by interconnected pathways and through a machine bus (25) of the textile machine (10).

12 Claims, 3 Drawing Sheets

10
11
12
20
21
22
23
23'
24
25
26
27
SC
31a
32a
31b
32b
30b
31c
32c
30c
31d
32d
30d
30a
40
41a
42
43
41b
41c
41d
44
45
62a
62b
62c
62d
63
63'
64a
64b
64c
64d 10
11
12
20
21
22
23
24
25
26
27
30a
30b
30c
30d
31a
31b
31c
31d
32a
32b
32c
32d
40
41a
41b
41c
41d
42
43'
44'
62a
62b
62c
62d
63
63'
65a
65b
65c
65d
70
71
72
73
74
75
76
77

TEXTILE MACHINE WITH MULTIPLE WORK STATIONS AND A MACHINE BUS FOR COMMUNICATION

BACKGROUND

The invention concerns a textile machine with a multiplicity of workstations, a central machine control and a machine bus for communication between the machine control and each, or possibly a group of electronic devices associated with each workstation, wherein a sensor device is located at each workstation.

A textile machine made known by EP 0 832 997 A2 possesses a multiplicity of workstations and respectively, a workstation electronic device is placed at each said workstation. The workstation electronic devices are respectively grouped with a section controller by a connection through a data interface. Section controllers are, in turn, interconnected by a data line to a machine bus. The machine bus is further connected to a machine center in such a manner, that the machine center controls the sectional controllers which are connected in parallel along the machine bus. This arrangement accordingly provides control for the workstation electronic devices. At each workstation electronic device a thread-monitor is located, which detects the presence of a thread at its assigned workstation and in a case of absence of a thread, transmits a corresponding signal to the workstation electronic device. The body of information transmitted from the thread-monitor, that is, the data throughput demanded for this purpose, is very small, since the information provided, i.e. "Thread Lacking", for example, is only given out by a break in the running thread. This is an event which occurs but seldom.

In the case of a disclosed communication structure, namely from WO 85/01073, the workstations of a textile machine are monitored by respective warning instruments. In this way, the sensors are placed at each workstation and accordingly transmit analog thread-signals to a processor. Analog thread-signals from a group of monitoring sensors can be evaluated by one processor and subsequently transmitted in digital form through a communication channel to a communication processor. Several processors are connected in parallel onto the said communication channel. The data, which are transmitted from the processors to the communication channel, are received by a centralized unit of the thread monitoring system and are there evaluated.

From this centralized unit, in turn, alarm signals and commands for intervention are sent over a communication connection to a control center of the textile machine. Because of the thread-signal, the monitoring at the workstations requires a stand-alone communication structure.

SUMMARY

It is the purpose of the invention to create an economical communication structure for the monitoring of the workstations of a textile machine. Additional objects and advantages of the invention will be set forth in part in the following description, or may be obvious from the description, or may be learned through practice of the invention.

The textile machine in accord with one embodiment of the invention encompasses a multiplicity of workstations and respectively one electronic device per workstation. A workstation is usually a spinning station of an open end spinning machine, a winding point, or the like. The textile machine is monitored and regulated by a machine control center in order, for example, to detect failure at a workstation, to take individual workstations out of production, or to shut down or to start up an entire machine. By means of a machine bus, the machine control remains in communication with the electronic devices of the workstations or in some cases with a group of such electronic devices. The communication, in this arrangement, is bidirectional, so that commands are transmitted from the machine control to the electronic device or, conversely, error conditions captured by the electronic device at the workstation are sent to the machine control.

Besides the electronic device, at each workstation a sensor apparatus is installed, which carries out a supervisory function. With its high scanning frequency of a plurality of values per second the sensor apparatus picks up a characteristic values at the workstation. Extremely advantageously in this case, a sensor is included in the apparatus for the monitoring of the thread quality of the thread produced or processed at the individual workstation.

Besides the centralized machine control, a central evaluation unit is assigned to the textile machine for the evaluation of sensor data and/or the data which are therefrom derived. To obtain a substantially reduced data throughput, the sensor data capture, in this arrangement, primary data, which are generated at each sensor, or, conversely, the quality or signal data derived therefrom.

The central evaluation unit, with this two-way circuit, makes decisions overriding the sensors in regard to the textile machine. When, the thread quality is monitored by the sensor apparatus, then the advantage of this override is that from the thread quality values of any one of the individual sensors, the central evaluation unit can make one evaluation which governs all workstations on the textile machine. The central evaluation unit weighs, in this manner, the primary sensor data, the data corresponding to the measured values, and advantageously the secondary quality or signal data derived therefrom. This derived secondary quality or signal data include, for example, classification information for the thread, thread fault-signals, technical alarms regarding the operational readiness of the sensor apparatus or the like. The central evaluation unit can proceed still further in the processing of the derived, secondary quality-data. For instance the evaluation unit can execute spectrograms of the thread quality and determine CV-values. This can be done either for all workstations of the textile machine or for individual workstations.

The central evaluation unit is connected by a first communication line with the machine control or, preferably, is directly connected to the machine bus. By the said direct connection of the evaluation unit through the first communication line to the machine bus, the quantity of distributable sensor data to be forwarded from the machine control to the central evaluation unit is substantially reduced. In this way, a diminution of the load on the machine control is attained. The sensor apparatuses are connected by a second communication line to the evaluation unit, wherein the second communications line includes at least the machine bus and the first communication line. With this advantage, the transmission of the sensor data for each of the sensor apparatuses to the central evaluation unit will at least be to some extent picked up on the communication and control structure of the textile machine. It then becomes unnecessary to provide a dedicated, separate communication structure for the sensor apparatus and its evaluation unit. In this way, the expense on the wiring between the sensor apparatuses and the central evaluation unit is considerably reduces If such provision has been made, in this case, for example, also the adjustment of the sensor apparatus can be carried out over this communication structure with the use of the machine bus. In this case, it is of particular advantage to design the second communication line to be bidirectional in nature. Among other advantages, the reaction times are considerably reduced, when the sensor apparatuses emit signals, which, for instance, are to be evaluated only at the central machine control, since the central evaluation unit, in this case, need not be interposed.

As already mentioned, it is preferential, that from the primary, measured characteristic values for data reduction, only the quality or signal data derived therefrom need be transmitted over the communication structure. The transmission of this secondary data is carried out either continuously, that is, as data accumulates with each sensor apparatus, or packetwise, that is, upon the accumulation of a certain quantity of data or upon a demand from the central evaluation unit. Particularly advantageously, the transmission can occur at predetermined time periods, for instance in timed minute spans, wherein the sensor apparatuses are time-adjusted to release their data to the central evaluation unit in an appointed time window.

In the case of a large number of workstations per textile machine, advantageously, correspondingly more workstations would be assigned to a group, that is, coalesced into a section, which in turn would be connected to a section controller which would be tied into the machine bus. The connection between the group of electronic devices with the section unit can be a star-shaped connection, preferably by a section bus. Likewise, in this case, the sensor apparatuses are subdivided again groupwise, whereby, advantageously, the size of the group and the groupings hereof are compatible to those of the electronic apparatus of the workstations. The communication between the central evaluation unit and the sensor apparatuses is done, in this case, sectionally through a third communication line, which runs between a section and the sensor apparatuses. The third communication connection can be provided directly between the section units and the sensor apparatuses or can be accomplished by an interposed switching in of the sectional bus. In the case of a direct connection between the controllers and the section units, this is also advantageously constructed in star formation.

In a further embodiment of the present invention, the sensor apparatuses are not connected directly with the section units, nor with the section bus, but by a sensor-section-element, on which, once again, the sensors are star connected with one another, or communicate with each other by a sensor-section bus.

Forwarding of the sensor data is done, in this case, from the sensor apparatus to the sensor section unit and from this to the section unit either by section bus or by direct connection thereto. Provision can also be made, that from this sensor apparatus the communication can be accomplished directly to machine bus.

Very advantageously, each sensor apparatus possesses a communication means and/or an evaluation unit for making available secondary, derived quality or signal data. With this communication means, digital signals can be directly transmitted and, in the case of a bidirectional tie, also received.

If the captured measured values, i.e., the primary characteristic values, have been already evaluated by the sensor apparatus, then the data to be transmitted have been substantially reduced. If the sensor apparatus possesses both a communication means as well as an evaluation unit, then, an autonomically reacting sensor apparatus is in place. If this is the case, then a sensor section unit may be dispensed with and communication may be established direct to the machine bus, to the section controller, or to the section bus.

Very much to advantage, besides making use of the communication and control structure of the textile machine, is that also an existing power supply can be put to use on the textile machine for the electronic elements of the workstations. Besides sparing the costs of connection for the communication, additionally the wiring costs for a separate, individual electrical current supply are also avoided.

In the case of the procedure for transmission of sensor data where a textile machine is concerned, in accord with claim 12, the transmission of sensor data, at least batchwise, is accomplished by a machine bus of the textile machine. As mentioned above, also in this case, a separate communication structure for the central evaluation of the sensor data may be discarded.

BRIEF DESCRIPTION OF THE DRAWINGS

With the aid of the drawing, embodiments of the invention are explained in greater detail. There is shown in.

DETAILED DESCRIPTION

Figure 1:
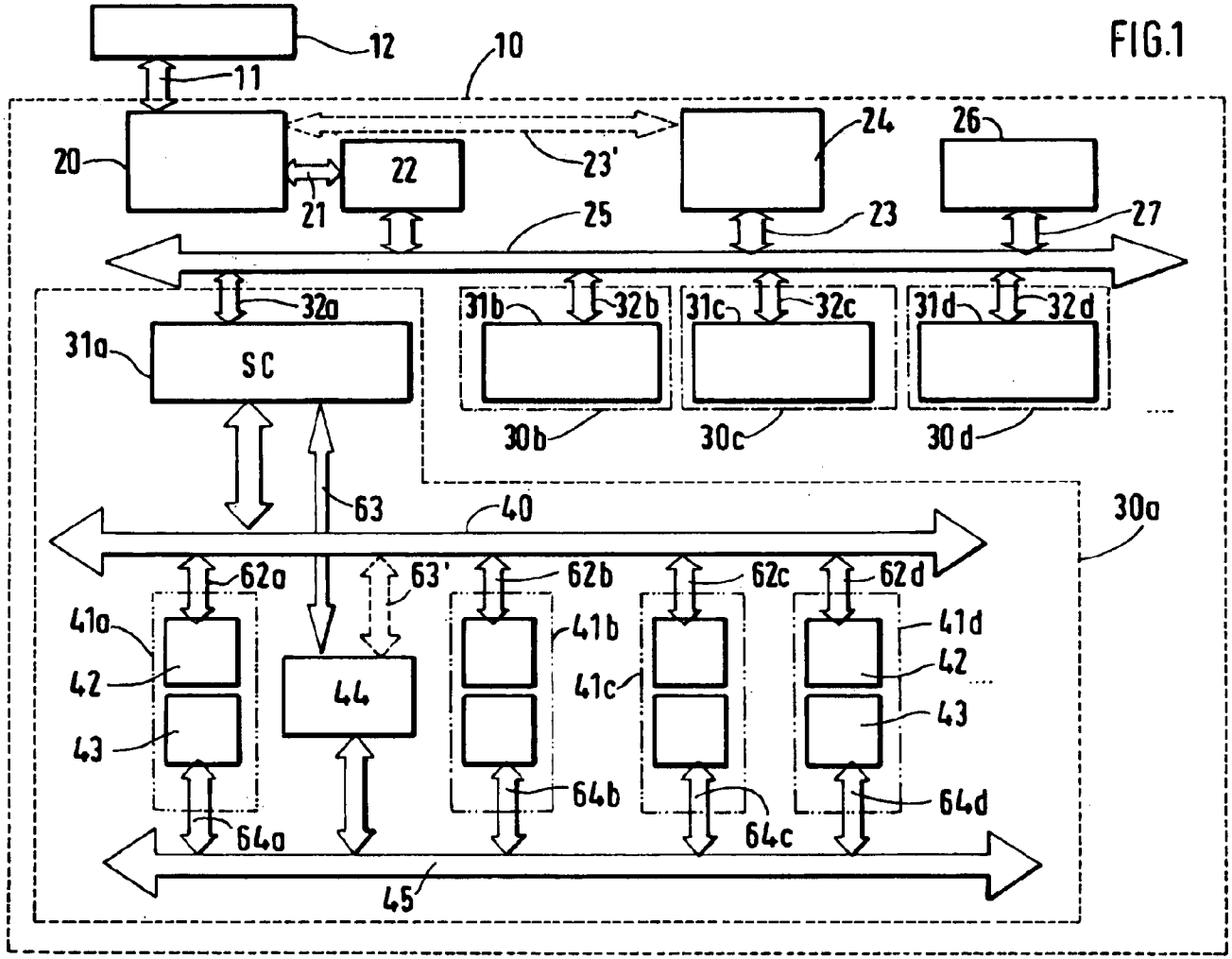
FIG. 1 a communication structure for a spinning machine for the transmission of quality data in accord with a first embodiment, FIG. 2 a communication structure in accord with a second embodiment wherein further a supply network is presented, and FIG. 3 a communication structure in accord with a third embodiment example.

Reference will now be made in detail to embodiments of the invention, examples of which are shown in the drawings. Each embodiment is provided by way of explanation of the invention, and not as a limitation of the invention. For example, features shown or described as part of one embodiment may be used with another embodiment to yield still a different embodiment. It is intended that the present invention include these and other modification and variations.

FIG. 1 shows, in a schematic manner, a communication structure in accord with the embodiment for an open-end spinning machine 10. The open-end spinning machine is controlled by a central machine control 20. Optionally, this central machine control 20 can be connected through an external line 11 to a general works control 12. The works control 12 regulates or controls, for example, several parallel operating spinning machines 10 or pre/post-positioned workstations of the spinning machine. The machine control 20 is in communication by a line 21 for data exchange with a CAN-distributor 22 (router). For the data exchange between the elements of the spinning machine 10, the CAN-distributor 22 operates through a machine bus 25 (CAN-bus). By a communication line 23, a central quality evaluation unit 24 is connected to the machine bus 25. The central quality evaluation unit 24 further stands in connection through a still to be described communication structure with thread cleaners 43 for data exchange. The quality evaluation unit 24 operates independently form the central machine control 20, although it can both send and receive control data therefrom.

Instead of the communication line 23, in another embodiment, provision can be made for a communication tie link 23' directly between the machine control 20 and the evaluation unit 24. The communication line 23 is, however, to be preferred, since this relieves the central machine control 20 of nothing more than simple data passage from the bus 25 to the said evaluation unit 24. Further, the evaluation unit 24 can be installed spatially independently of the machine control 20.

In addition on the machine bus 25 and connected by communication line 27 is a service cart 26 with a start-up aggregate for the spinning machine 10. Additionally, although not shown here, startup robots are likewise connected by communication line to the machine bus 25.

The spinning stations 41*a–d* are combined groupwise in a section 30*a–d*, whereby in FIG. 1, only the spinning stations 41*a–d* and the section 30*a* are shown in detail. Each section includes a section controller 31*a–d*, whereby each section controller 31*a–d* is connected respectively by communication line 32*a–d* to the machine bus 25. Each section controller 31*a–d* also exercises a router function for the data exchange between a section bus 40 and the machine bus 25. In this way, the section bus 40 is controlled from the section controller 31*a*. A section electronic device 42 as well as a thread cleaner 43 is assigned to each spinning station 41*a–d*. Each spinning station 41*a–d* is connected by a communication line 62*a–d* to the section bus 40. To each section electronic device 42, for example, is connected a thread monitor, which monitors thread-presence at the spinning station. The section electronic device 42, being equipped with appropriate sensors and actuators, is also connected to a feeding means, which, for example, inserts a fiber matting band into a disintegrating roll at the spinning station. The communication structure of the spinning machine 10, as described up to this point, is identical to that of the second and third embodiments as presented in FIGS. 2 and 3. In the following, on this account, the described elements are provided with the same reference numbers.

In the case of the first embodiment, according to FIG. 1, the thread cleaners 43 are in connection with a cleaner bus 45 through the tie-lines 64*a–d*. Similar to the section controller 31*a*, the cleaner bus is controlled and operated by a cleaner section unit 44. The cleaner section unit 44 has primarily a router function, although it can also, in a sectional manner, evaluate the data transmitted from the thread cleaners 43 and, in some cases, transmit control data especially to the section controller 31*a*, in order, for example, to act through the section electronic device 42 on the operation of the spinning stations 41*a–d*.

The cleaning section controller 44 is connected directly by a communication line 63 with the section controller 31*a* or, in a preferred formulation, by means of a communication line 63' to the section bus 40 through the said section controller 31*a* . With this communication structure, communication is effected between the evaluation unit 24 and a thread cleaner 43 through the communication line 23 (that is to say, the communication line 23', the machine control 20 to the distributor 22) to the machine bus 25, the communication line 32*a–d*, the section controller 31*a–d*, the section bus 40 and the communication line 63' (or the communication line 63) the cleaning section unit 44, the cleaning bus 45, the communication line 64*a–d* and finally to the thread cleaner 43. Correspondingly, the communication can run in the reversed order.

Examples for the data exchange are stated in the following: From the evaluation unit 24, a software download/upload is carried out for the thread cleaner 43 as a downlink through this communication structure to the thread cleaner 43. Or, in a batch, i.e., a party-exchange at the spinning machine 10, (that is, upon the alteration of the quality or the kind of thread to be produced by the spinning station) new adjustment parameters for thread cleaning are transmitted in the downlink from the quality evaluator to the thread cleaner 43.

In the case of the embodiment presented here, each thread cleaner 43 possesses its own integral evaluation processor along with a communication processor, so that the thread quality, which has been captured in analog form by means of the sensor component of the thread cleaner 43, is converted to digital values and subjected to a preliminary evaluation. The preliminary evaluation embraces, among other things, a classification of the measured thread value, as this is generally known, the determination of thread faults, and if a thread break need be carried out. These quality values, i.e., control data, are then transmitted from uplink through the communication structure from the thread cleaner 43 to the central evaluation unit 24. If, beyond this, for instance at the spinning station 41*a* the thread quality requires an artificial thread break, then from the thread cleaner 43 a corresponding control demand is made over the communication line 64*a*, the bus 45, the cleaning section unit 44, the communication connection 63', the section bus 40 to the section electronic device 41*a* (or through the alternate path of the section controller 31*a* in case of the connection 63). The completion of this message then releases by control means of the feed of the fiber band (stop demand) an artificial thread break. At the same time, of course this information is further forwarded to the evaluation unit 24 for the statistical evaluation.

The central quality evaluation unit 24 then produces statistic data from the input of quality and/or control data. For example, it calculates average or absolute quality schemata in the form of the known quality matrices, this is either concerning a single spinning station 41*a–d*, sectionwise 33*a–d* or is valid for all spinning stations of the spinning machine 10. Along with this, it is also possible that spectrograms, CV-values and the like can also be determined with reference to spinning stations, sections of spinning stations. This form of the communication and evaluation is also valid, especially for the further embodiments.

Figure 2:
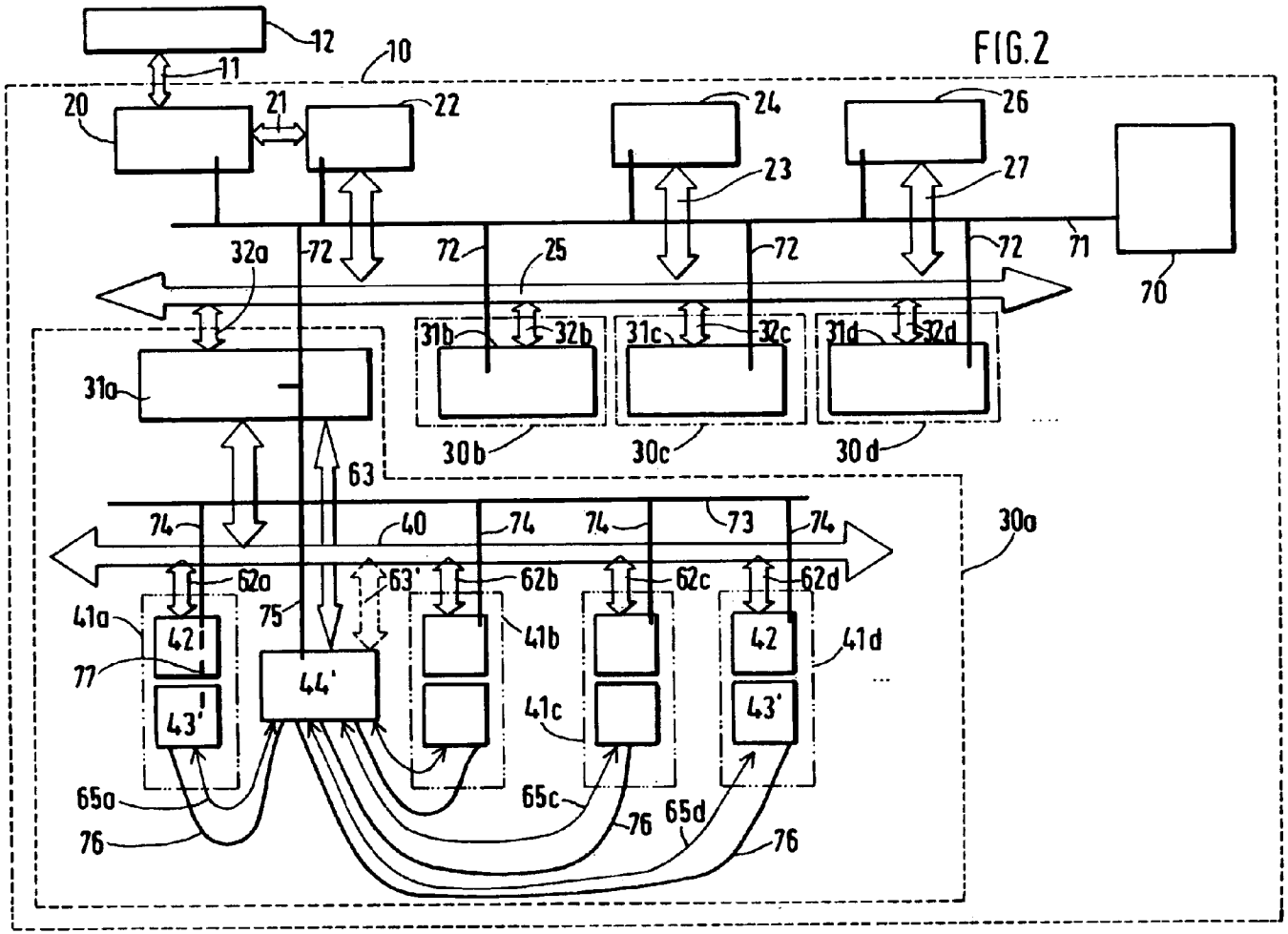

FIG. 2 demonstrates a communication structure according to a second embodiment This represents partially, that of FIG. 1, with the difference, that in this case the electrical current feed to the individual section electronic devices 42 and the thread cleaners 43 is additionally shown and the communication between the thread cleaners 43' and the cleaner section unit 44' deviates from that of FIG. 1. The supply of current, however, is applicable to the structure of FIG. 1.

In this case, the thread cleaners 43' stand individually communicatively connected through connections 65*a–d* in star-shaped arrangement with cleaner section unit 44'. The thread cleaners 43' could be designed in accord with the thread cleaners 43, wherein the communication over connection 65*a–d* would be carried out in a digital exchange. Advantageously, however, the thread cleaners 43' are analog sensor heads and by the communication connection 65*a–d*, principally control-potentials are applied from the cleaning section unit 44' onto the thread cleaners 43', and conversely, by means of the communication connection 65*a–d* analog values of the thread cleaner are transmitted to the cleaner section unit 44'. In this case, the thread cleaners operate as sensor heads without themselves processing the measured values. The necessary evaluation is then accomplished by the cleaner section unit 44', so that from that source, corresponding control data and quality data for each spinning station 41*a–d* are made available. The transmission from the cleaner section unit 44, for example, to the central evaluation unit 24 is executed analogously to the path described for FIG. 1, and likewise, the downlinks from the evaluation unit 24 to the cleaner section unit 44'. In this case the adjustments, that is, software updates, are not undertaken in the thread cleaners 43', but rather in the cleaner section unit 44'.

Further, in FIG. 2 a current supply structure is presented. The voltage supply runs from one central current supply unit 70 through cable 71, parallel to the machine bus 25, and from cable 71 through the branches 72 to the section controllers 3*a–d*.

In this way, the current supply unit 70 can make available a plurality of supply potentials (for instance, 24 volt, 50 volts or 12 volts) by means of the cable 71, or principally produce only one supply potential, namely 24 volts. In each section controller 31*a–d,s* there is provided a terminal for energy supply. Further, the branches 72 are extended to a distributor cable 73, which also runs parallel to the section bus 40. From the distributor cable 73 run again branches 74 to each spinning station electronic 42, which then supplies the sensors and actuators with voltage. Further a line 75 branches off of the distributor cable 73 which delivers potential to the tread cleaner section unit 4 4'. Up to now, the corresponding structure is interchangeable with that of FIG. 1. Power lines 76, in star connection, run from the cleaner section unit 44' parallel to the communication connections 65*a–d* and supply the thread cleaners 43'. Parallel, in the sense of the description is to be interpreted as not necessarily physically parallel, but rather parallel in relation to the communication structure. From the state of the construction, of the spinning machine, however, a physical parallel lay of the lines is also of merit, since then energy supply and communication lines can be bundled together.

In a further embodiment, it is possible that instead of the lines 76, even branching can be carried out by the extension of the spinning station electronic 42 to the thread cleaners 43.

Figure 3:
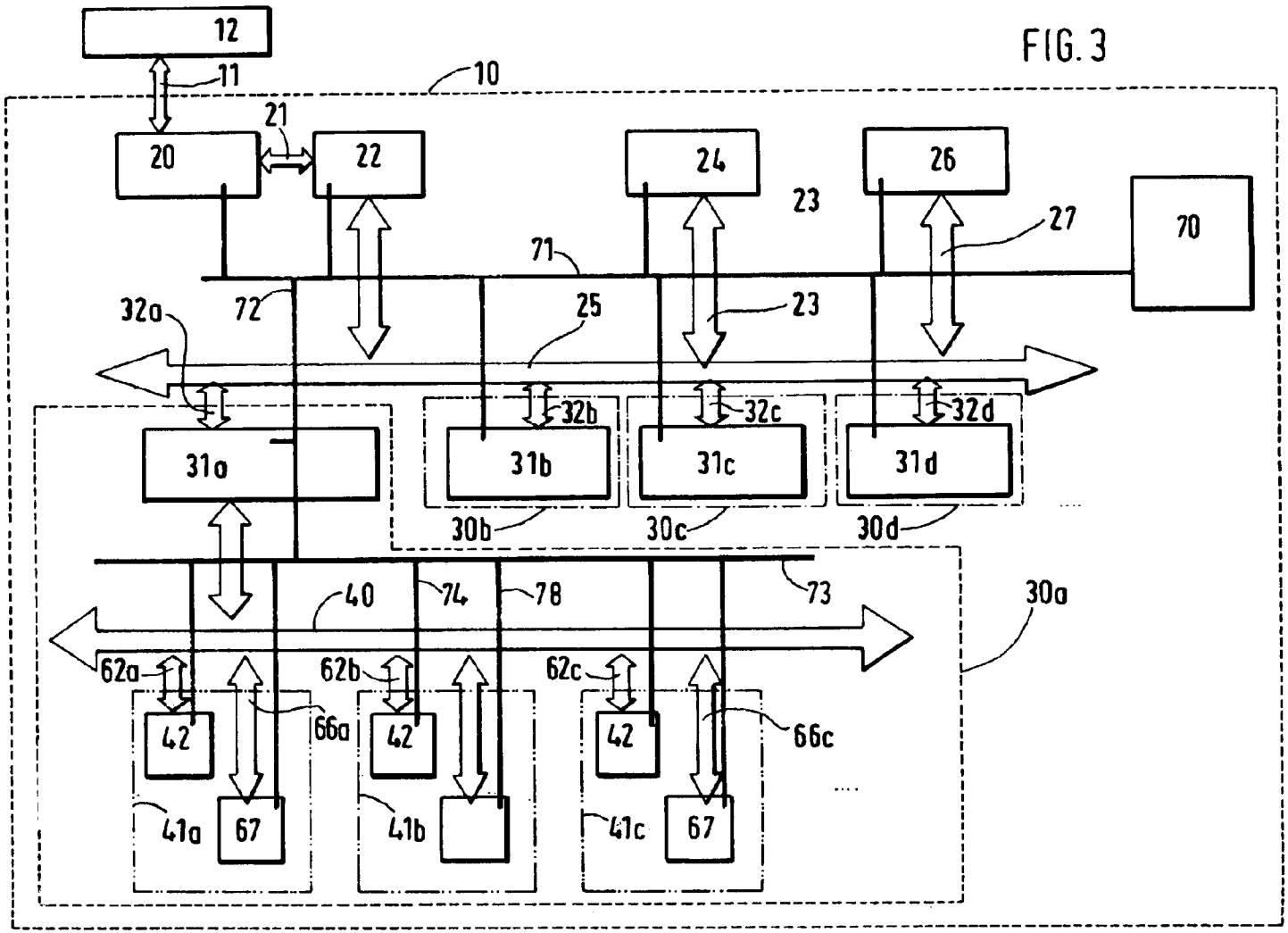

FIG. 3 shows a third embodiment of the communication structure, with a further layout design of the current supply system. In deviation from FIG. 1, in this case omissions included the connections 63 and/or 63', the cleaning section unit 44 and the cleaner bus 45. Instead of the communication ties 64*a–d* to the cleaner bus 45, in this case the thread cleaner is connected directly to the section bus 40 by means of the communication tie 66*a–d*. Similar to the case of the first embodiment, the thread cleaner 67 includes here an evaluator electronic system, with which, possibly, analog measurement data are converted to digital measurement data and is then subjected to a preliminary evaluation. This data is then transmitted through a communication apparatus in the measuring head through the communication connection 66*a–d* to the section bus 40. Data and control data are then available from this bus 40.

In the case of the power distribution structure of FIG. 3, the thread cleaners 67 are connected to the distributor 73 by tie lines 78. Such a structure can also be provided which corresponds to the structures of FIG. 1 and FIG. 2.

It should be appreciated by those skilled in the art that modifications and variations can be made to the embodiments described herein without departing from the scope and spirit of the invention as set forth in the claims and their equivalents.

What is claimed is:

1. A textile machine, comprising:

a plurality of workstations, each said workstation comprising a sensor apparatus and an electronic device for individual control of said workstations;

a central machine control;

a machine bus providing communication between said central machine control and said electronic devices or groupings of said electronic devices;

an independent sensor evaluation unit designated for evaluation of workstation specific sensor data received from said workstation sensor apparatuses, said sensor data being characteristic values continually measured by said sensor apparatuses, or values derived from said characteristic values, relating to a process or product produced at said respective said workstations;

said sensor evaluation unit connected to said central machine control by a first communication connection;

each said sensor apparatus connected to said sensor evaluation unit by a second communication connection; and said second communication connection comprising at least said machine bus and said first communication connection.

2. The textile machine as in claim 1, wherein first communication connection comprises a connection from sensor evaluation unit to said machine bus, said machine bus in communication with said central machine control.

3. The textile machine as in claim 1, wherein said first communication connection comprises a direct connection from said sensor evaluation unit to said central machine control.

4. The textile machine as in claim 1, wherein said second communication connection is bi-directional.

5. The textile machine as in claim 1, wherein said workstation electronic devices of a grouping of said workstations are connected to a section controller, said section controller connected to said machine bus.

6. The textile machine as in claim 5, wherein each said workstation electronic device within a respective said grouping is connected to said section controller by a section bus.

7. The textile machine as in claim 5, wherein said sensor apparatuses of said workstation grouping are connected to said section controller, said section controllers connected to said machine bus.

8. The textile machine as in claim 7, wherein said sensor apparatuses of said workstation grouping are connected to a sensor section unit, said sensor section unit connected to said section controller.

9. The textile machine as in claim 1, wherein said sensor apparatuses derive sensor data from measured characteristic values and supply said sensor data to said sensor evaluation unit.

10. The textile machine as in claim 1, further comprising a power supply source for supply of power to said workstation sensor apparatuses and said electronic devices.

11. A textile machine, comprising:

a plurality of workstations, each said workstation comprising a sensor apparatus and an electronic device for individual control of said workstations;

a central machine control;

a machine bus providing communication between said central machine control and said electronic devices or groupings of said electronic devices;

a sensor evaluation unit for evaluation of workstation specific sensor data received from said workstation sensor apparatuses, said sensor data being characteristic values continually measured by said sensor apparatuses, or values derived from said characteristic values, relating to a process or product produced at said respective said workstations;

said sensor evaluation unit connected to said central machine control by a first communication connection;

each said sensor apparatus connected to said sensor evaluation unit by a second communication connection;

said second communication connection comprising at least said machine bus and said first communication connection;

a power supply source for supply of power to said workstation sensor apparatuses and said electronic devices; and wherein said power supply source comprises a main distribution cable from a current supply source, said sensor apparatuses and said electronic devices connected to said main distribution cable.

12. The textile machine as in claim 11, wherein said workstation electronic devices of groupings of said workstations are connected to a respective section controller, said section controllers connected to said machine bus, and further comprising a branching line from said main distribution cable to each of said section controllers, said section controllers electrically connected to a respective sensor section unit, said sensor apparatuses and said electronic devices electrically connected to said sensor section units for supply of power to said sensor apparatuses and said electronic devices.

* * * * *